United States Patent [19]

Ray

[11] Patent Number: 4,471,831

[45] Date of Patent: Sep. 18, 1984

[54] APPARATUS FOR RAPID SOLIDIFICATION CASTING OF HIGH TEMPERATURE AND REACTIVE METALLIC ALLOYS

[75] Inventor: Ranjan Ray, Burlington, Mass.

[73] Assignee: Allied Corporation, Morris Township, Morris County, N.J.

[21] Appl. No.: 474,735

[22] Filed: Mar. 17, 1983

Related U.S. Application Data

[63] Continuation of Ser. No. 220,401, Dec. 29, 1980, abandoned.

[51] Int. Cl.[3] ..... B22D 11/06; B22D 11/10; B22D 27/15

[52] U.S. Cl. ..... 164/508; 164/256; 164/423; 164/429; 164/437

[58] Field of Search ..... 164/508, 506, 423, 427, 164/429, 438, 437, 256

[56] References Cited

U.S. PATENT DOCUMENTS

| | | | |
|---|---|---|---|
| 3,342,250 | 9/1967 | Treppschuh et al. | 164/438 X |
| 3,633,654 | 1/1972 | Auman et al. | 164/437 X |
| 4,077,462 | 3/1978 | Bedell et al. | 164/429 |
| 4,257,830 | 3/1981 | Tsuya et al. | 164/423 X |
| 4,386,896 | 6/1983 | Ray | 425/7 |

FOREIGN PATENT DOCUMENTS

| | | |
|---|---|---|
| 2410368 | 6/1979 | France . |
| 903530 | 8/1962 | United Kingdom . |
| 1428691 | 3/1976 | United Kingdom . |
| 1517283 | 7/1978 | United Kingdom . |

OTHER PUBLICATIONS

Technical Report AFML-TR-78-70, Final Report Jan. 1975-Aug. 1977, Amorphous Glassy Metal and Microcrystalline Alloys for Aerospace Applications, pp. 13-17.

*Primary Examiner*—Nicholas P. Godici
*Assistant Examiner*—J. Reed Batten, Jr.
*Attorney, Agent, or Firm*—James Riesenfeld; Gerhard H. Fuchs; Michael J. Weins

[57] ABSTRACT

An apparatus for rapid solidification casting of molten high temperature and/or reactive metallic alloys has a heat extraction crucible for containing the alloy in liquid form. A nozzle forms an integral part of the crucible and allows for ejection of a stream of molten metal. The heat extracting crucible and nozzle are protected from the molten alloy by a shell of the alloy which has solidified and prevents reaction between the molten metal and the heat extracting crucible.

7 Claims, 4 Drawing Figures

APPARATUS FOR RAPID SOLIDIFICATION CASTING OF HIGH TEMPERATURE AND REACTIVE METALLIC ALLOYS

This application is a continuation of application Ser. No. 220,401, filed Dec. 29, 1980 and now abandoned.

FIELD OF INVENTION

The present invention relates to apparatus and method for rapid solidification casting of high temperature and/or reactive metallic alloys.

Copending application Ser. No. 220,561 filed Dec. 29, 1980 discloses equipment and method for melt extraction which employs a heat extracting crucible. The present invention discloses equipment and method for melt-spinning which employs a heat extracting crucible.

BACKGROUND OF THE INVENTION

Melt-spinning is one well established rapid solidification technique which has frequently been used to cast amorphous metal ribbons. To melt-spin a stable liquid jet of molten material is formed by ejection of the liquid through an appropriate orifice or nozzle, and then the jet of molten material is solidified on a moving heat sink. This technique is further described on pages 13 through 17 of a technique report, AFMR-TR-78-70 entitled "Amorphous Glassy Metals and Microcrystalline Alloys For Aerospace Applications" by E. W. Collings, R. E. Maringer, and C. E. Mobley. This report points out that while melt-spinning is particularly suited for producing the wire ribbon fibers of many nonreactive low melting alloys, the requirement of a stable crucible/orifice and jet severely limit the process utilization. The report states that titanium filaments have not been melt-spun since a stable crucible material is unavailable, and that operating difficulties with the orifice and jet have been encountered in attempts to melt-spin such materials as boron, beryllium and other reactive alloys.

High temperature nickel-base; nickel, chromium, titanium, aluminum alloys have been melted in water-cooled copper crucibles. For example, British Pat. No. 1,517,283 discloses the use of a water-cooled crucible for melting and containing nickel-base alloys. The metal is removed from the crucible by spinning the crucible about its axis to generate atomized particles of liquid which move out radially from the edge of the crucible. This patent offers no teaching that the metal can be extracted from the crucible through an orifice of limited dimensions.

British Pat. No. 1,428,691 discloses melting materials in water-cooled molds. The melt is then solidified in situ. Again, this patent offers no teaching of a technique for the extraction of liquid metal from a water-cooled mold through a constricted orifice.

Thus, while the above patents show a method for melting materials in water-cooled crucibles, they provide no teachings of the use of these crucibles for melt-spinning.

SUMMARY OF THE INVENTION

An apparatus for casting metal filaments directly from the melt is described. A crucible which is constructed of a thermally conductive material such as copper, brass, graphite, etc., is employed for holding a metal charge. Means for supplying heat to melt the metal charge contained in the crucible are employed to form a melt of molten metal. One or more cooling passages internal to said crucible for passing a cooling medium therethrough provides a solidified layer of the melt for preventing interaction between the melt and the crucible. A nozzle forming an integral part of the crucible is employed to eject a stream of molten metal, and a means for rapidly quenching the stream are provided. A means for controlling the ejection of the molten metal allows the charge to be fully melted before the molten material is ejected.

In another preferred embodiment, a method for making continuous metal filaments directly from a melt is described. A charge of molten metal is contained in a crucible with an attached nozzle. A solidified layer of the melt is provided to prevent interaction between the melt and the crucible. The molten metal is ejected through the nozzle and forms a stream. The stream impinges onto a chill surface provided by a heat extracting member. As the chill surface is advanced, the molten stream is quenched by the chill surface at a rapid rate and produces a continuous metal strip.

BEST MODES OF CARRYING THE INVENTION INTO PRACTICE

Figure 1:
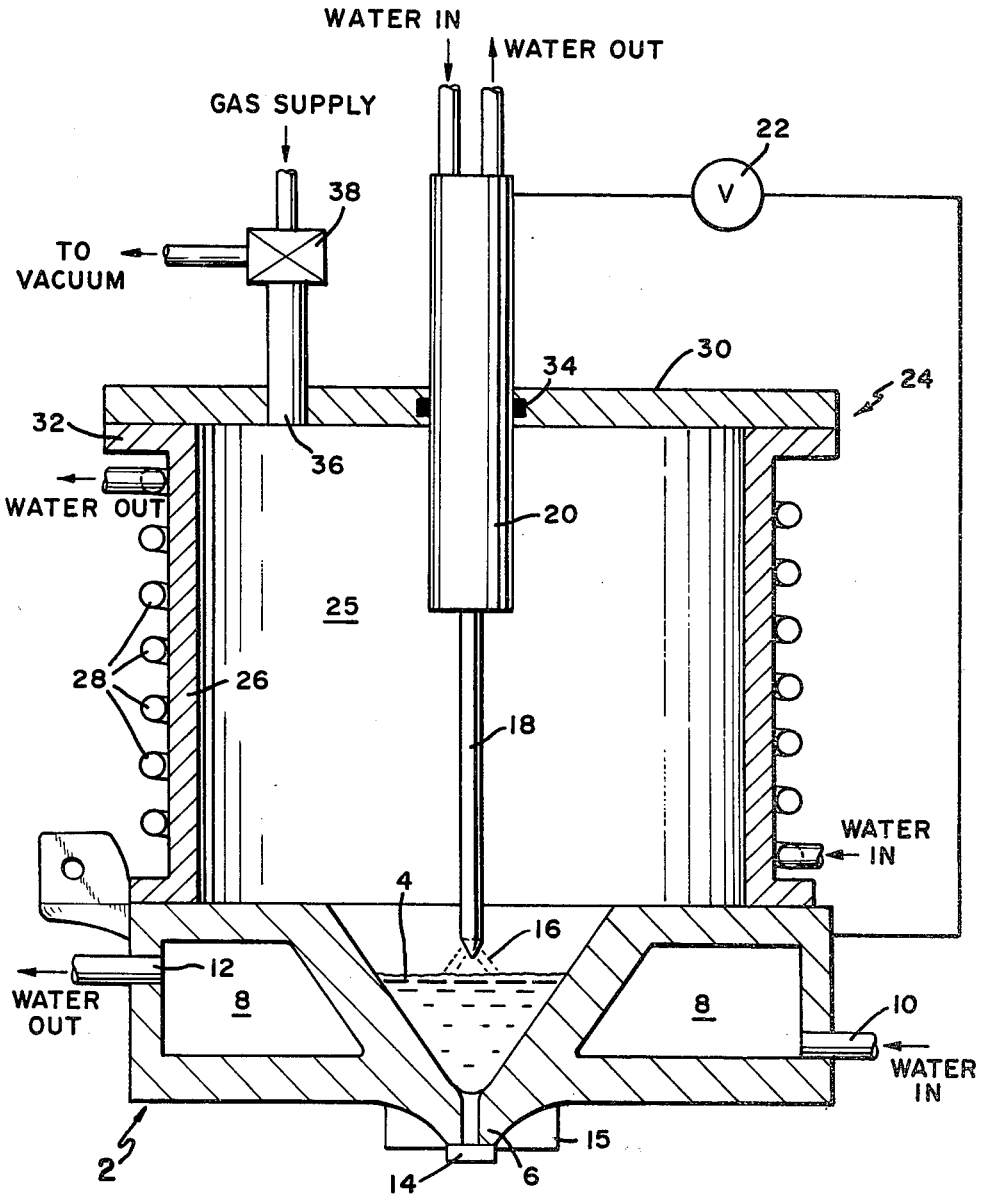
FIG. 1 is a schematic representation of one molten material supply of the present invention which employs a single electrode.

Referring to FIG. 1 a heat extracting crucible 2 is employed for containing molten metal 4. A nozzle 6 is attached to heat extracting crucible 2 and forms an integral part thereof.

The heat extracting crucible 2 and the nozzle 6 are preferably made of a high conductivity material such as copper, brass or graphite. In order to increase the heat extracting capacity of the heat extracting crucible 2, it is preferred that the crucible have a channel 8 for the passage of water therethrough. The water inlet 10 and outlet 12 allow the water to flow through the channel 8.

The molten metal 4 is ejected through the nozzle 6. The flow of the molten metal 4 is controlled by a shutter 14. The shutter is guided by a track 15.

Heat is supplied to a metal charge and/or to the molten metal 4 by an arc 16 which is struck between an electrode 18 and the charge of the molten metal 4. The electrode 18 is attached to an electrode holder 20 which is water-cooled. A potential is supplied by voltage supply 22 between the electrode holder 20 and the heat extracting crucible 2. It should be appreciated that other heating means such as an e-beam or a laser beam could be employed to supply heat to the molten metal 4.

The heat extracting crucible 2 has a crucible cover 24 attached thereto. The crucible 2 and the crucible cover 24 form a chamber 25 which provides control of the atmosphere over the molten metal 4. The crucible cover 24 has sidewalls 26 which are watercooled by cooling coils 28.

The crucible cover 24 has a removable top 30. The top 30 is connected to the sidewalls 26 via a flange 32. Electrode holder 20 passes through the removable top 30 and is electrically insulated from the top by seal 34. A gas outlet 36 in the removable top 30 is connected to a two-way valve 38. The valve 38 in one position allows gas to be evacuated from the chamber 25 by a vacuum pump (not shown) and in the second position allows an inert atmosphere such as argon to be supplied to the chamber 25.

Figure 2:
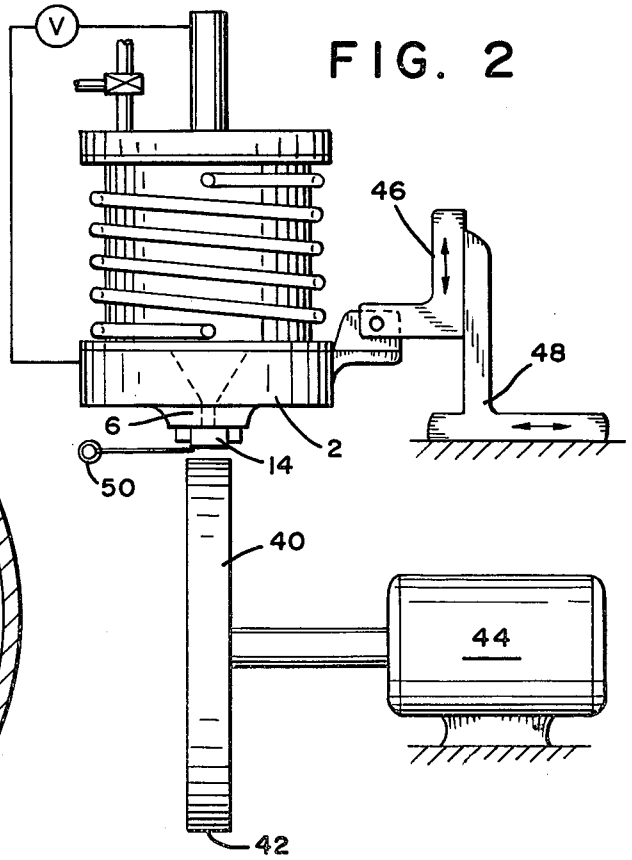
FIG. 2 is a schematic representation of the molten material supply of FIG. 1 used in combination with a chill casting wheel.

FIG. 2 is a schematic representation of the molten metal supply of FIG. 1 used in combination with a rotating chill wheel 40 having a circumferential edge 42. The chill wheel 40 is rotated by a motor 44. The heat extracting crucible 2 may be positioned relative to the chill wheel 40 by two orthogonal slide mechanisms 46 and 48. When the nozzle 6 is positioned near the peripheral edge 42 of the chill wheel 40, the shutter 14 is opened by the shutter release 50.

Figure 3:
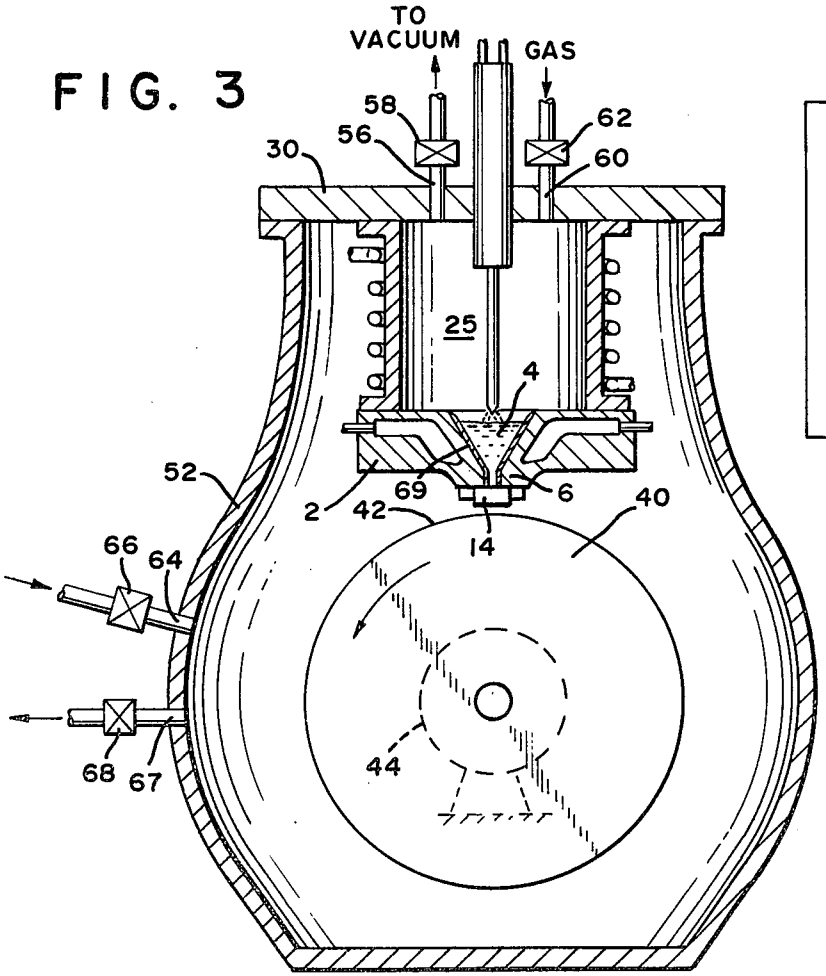
FIG. 3 is a schematic representation of a molten material supply and a chill wheel which are enclosed in a chamber to provide a controlled atmosphere.

When it is advisable to control the atmosphere in which the ribbon is cast as well as the atmosphere under which the material is melted, a second chamber 52 encloses the chill wheel 40 and the heat extracting crucible 2, as is illustrated in FIG. 3. The electrode holder 20 passes through the removable top 30 of the melt chamber 25. The removable top 30 also serves as the top of the second chamber 52. The removable top 30 has an inlet 56 for evacuating the melt chamber and a valve 58 to block the inlet 56. Likewise an outlet 60 having a valve 62 is used to provide a controlled atmosphere by the inlet of a gas such as argon. Inlet 64 and outlet 67 respectively allow evacuation and refilling of the second chamber 52 with a gas such as argon. The valves 66 and 68 control the flow of gas respectively through the inlet 64 and outlet 67.

When the molten metal 4 is fully molten, a skull 69 will be between the crucible 2 and the molten material 4. When the shutter 14 is removed from the nozzle 6, a stream will impinge on the peripheral edge 42 of the chill wheel 40.

Rather than employing a shutter 14, it is possible to use other means to constrain the flow of molten material through the nozzle 6. One such other means would be to place a small plug of low melting material in the nozzle 6. As the melt reaches temperature, the low melting material forming the plug in the nozzle would soften; and when the argon pressure is increased in the melt chamber 25, the plug would be dislodged from the nozzle 6, and a stream would flow through the nozzle 6.

Figure 4:
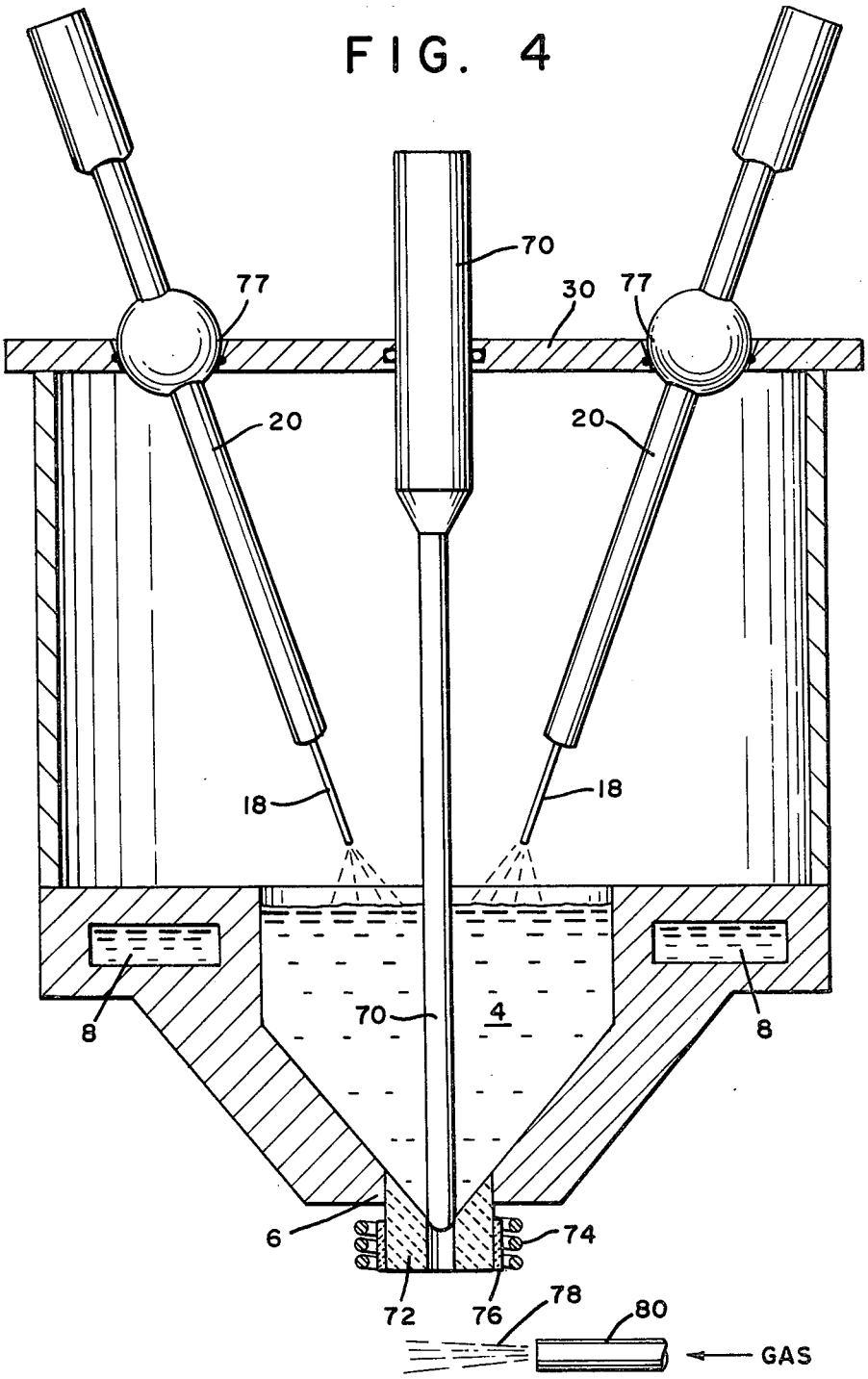
FIG. 4 is a schematic representation of a second molten material supply which employs two electrodes where the stream of molten metal is chilled and atomized by a gas stream.

Another means to control the ejection of a molten material is illustrated in FIG. 4. A watercooled stopper rod 70 is employed to block the passage of the nozzle 6. When the stopper 70 is raised, a stream will issue from the nozzle. The stream can be rapidly quenched by impinging the stream with a jet of gas 78 from a gas nozzle 80 thereby atomizing the stream and promoting its cooling to form a rapidlycooled powder product. An insulating nozzle sleeve 72 lines the nozzle 6 to define a passage having a diameter between about 0.06 and 0.10. The nozzle sleeve 72 may be heated by an induction coil 74 in the event that the nozzle sleeve is coupleable to the magnetic field of the induction coil, or alternatively a graphite susceptor 76 may be contacted to the nozzle sleeve and heat induced into the graphite susceptor 76.

For the configuration in FIG. 4, two electrodes are employed. The electrodes 18 are held in electrode holders 20, and mounted through the removable top 30 by pivotable sealed joints 77. A voltage from a supply (not shown) is applied between the two electrode holders. An arc is struck between the electrodes 18 and the molten material 4.

Example

An arc furnace similar to the furnace shown in FIG. 3 was employed. Both the melt chamber and the second chamber enclosing the rotating wheel were evacuated to $10^{-4}$ Torr and subsequently back-filled with high purity argon. The pressures in both chambers were equalized at about 20 cm of mercury. A charge weighing between about 50 and 100 grams was melted employing a non-consumable tungsten electrode.

The melt was ejected through the nozzle by sliding away the shutter while increasing the pressure in the furnace by about 10 cm of mercury. Typical orifice sizes for the nozzle were between about 0.06 inch and 0.1 inch. The lower limit assures that it is possible to maintain a stream which does not chokeoff, while the upper limit assures the flow will be sufficiently restrained to establish a filament of uniform cross-section.

Several metallic glass-forming alloys containing reactive metals such as titanium, zirconium, niobium and chromium were ejected onto the rotating wheels to form continuous ductile ribbons of good quality. Examples of the alloys cast were $Ti_{50}Cu_{50}$, $Zr_{70}Ni_{30}$, $Zr_{70}Ni_{15}Cu_{15}$, $Nb_{60}Ni_{40}$, and $Fe_{40}Ni_{30}Cr_{10}B_{20}$.

It is understood that although the present invention has been specifically disclosed with preferred embodiments and examples, modifications of these concepts herein disclosed may be resorted to by those skilled in the art. Such modifications and variations are considered to be within the scope of the invention.

What is claimed is:

1. Apparatus for casting metal filaments directly from the melt comprising, in combination;

(a) a crucible which is constructed of thermally conductive material for holding a metal charge;

(b) means for supplying heat to melt the metal charge contained in said crucible to form a melt of molten metal;

(c) at least one cooling passage internal to said crucible for passing a cooling medium therethrough to provide a solidified layer of the melt for preventing interaction between the melt and said crucible;

(d) a nozzle forming an integral part of said crucible and enclosing an insulating insert having a passage therethrough for ejection of a stream of molten metal, said passage having a diameter of between about 0.06 and 0.1 in.;

(e) means for rapidly quenching the stream of molten metal; and (f) means for controlling the ejection of the molten metal.

2. The apparatus of claim 1 wherein said thermally conductive material is electrically conductive, said means for supplying heat to melt the metal charge is at least one electrode associated with said crucible employed for striking an arc between said electrode and the metal charge contained in said crucible; and said means for rapidly quenching the stream of molten metal is a chill surface provided by a heat extracting member for deposition of molten metal thereon for quenching into filament, together with means for advancing said chill surface.

3. The apparatus of claim 2 wherein said means for controlling the ejection of the metal stream comprises a shutter which, when closed, blocks the flow of metal through said nozzle and a sealed crucible cover to provide a crucible chamber for controlling the pressure in the crucible chamber, thereby providing a means for increasing the hydrostatic pressure on the melt to assist in the ejection of the melt through said nozzle.

4. The apparatus of claim 2 wherein said means for supplying heat comprises at least two electrodes.

5. The apparatus of claim 1 wherein said means for rapidly quenching the stream of molten metal comprises a source of a gas jet for impinging on the stream.

6. The apparatus of claim 1 further comprising an induction coil for heating the insert.

7. The apparatus of claim 6 further comprising a graphite susceptor in contact with the insert and magnetically coupled to the coil.

* * * * *